United States Patent [19]

Hunwick

[11] 4,039,348

[45] Aug. 2, 1977

[54] TREATMENT OF RAW SUGAR JUICE

[75] Inventor: Richard James Hunwick, Wollstonecraft, Australia

[73] Assignee: Dorr-Oliver Incorporated, Stamford, Conn.

[21] Appl. No.: 567,522

[22] Filed: Apr. 14, 1975

[30] Foreign Application Priority Data

Apr. 17, 1974 Australia ..... 7275/74

[51] Int. Cl.[2] ..... C13D 3/00; C13D 3/16

[52] U.S. Cl. ..... 127/9; 127/11; 127/56; 210/84; 233/1 R

[58] Field of Search ..... 127/9, 11, 19, 46 R, 127/56; 210/73 R, 84

[56] References Cited

U.S. PATENT DOCUMENTS

| | | | |
|---|---|---|---|
| 968,327 | 8/1910 | Christianson | 127/56 |
| 1,101,940 | 6/1914 | Kopke | 127/56 |
| 1,156,060 | 10/1915 | Coombs | 127/56 |
| 1,897,424 | 2/1933 | Foster | 127/56 X |
| 2,478,971 | 8/1949 | Lindgren | 127/56 |
| 2,992,140 | 7/1961 | Gaiennie | 127/56 |
| 3,398,093 | 8/1968 | Ferney | 210/73 R |
| 3,501,346 | 3/1970 | Katzen | 127/56 |
| 3,808,050 | 4/1974 | Paley | 127/61 X |
| 3,989,628 | 11/1976 | Bier | 210/84 |

*Primary Examiner*—Sidney Marantz

*Attorney, Agent, or Firm*—Burtsell J. Kearns; Theodore M. Jablon

[57] ABSTRACT

A method of, and a system for, processing or treating raw sugar juice wherein raw sugar juice produced in a crushing mill is delivered to a first section of a partitioned surge chamber from which section it is withdrawn and subjected to a degritting process in one or more cyclone separators, the juice which is relatively free of heavy solids being subsequently delivered to a second section of the partitioned surge chamber from which section it is withdrawn for clarification in a clarifier and from which clarifier mud is withdrawn for subsequent treatment in one or more centrifugal separators, the removal of heavy solids, such as dirt and grit, during the degritting process being such as to reduce wear and erosion of the components in the centrifugal separators for processing the clarifier mud.

6 Claims, 3 Drawing Figures

Figure 1:
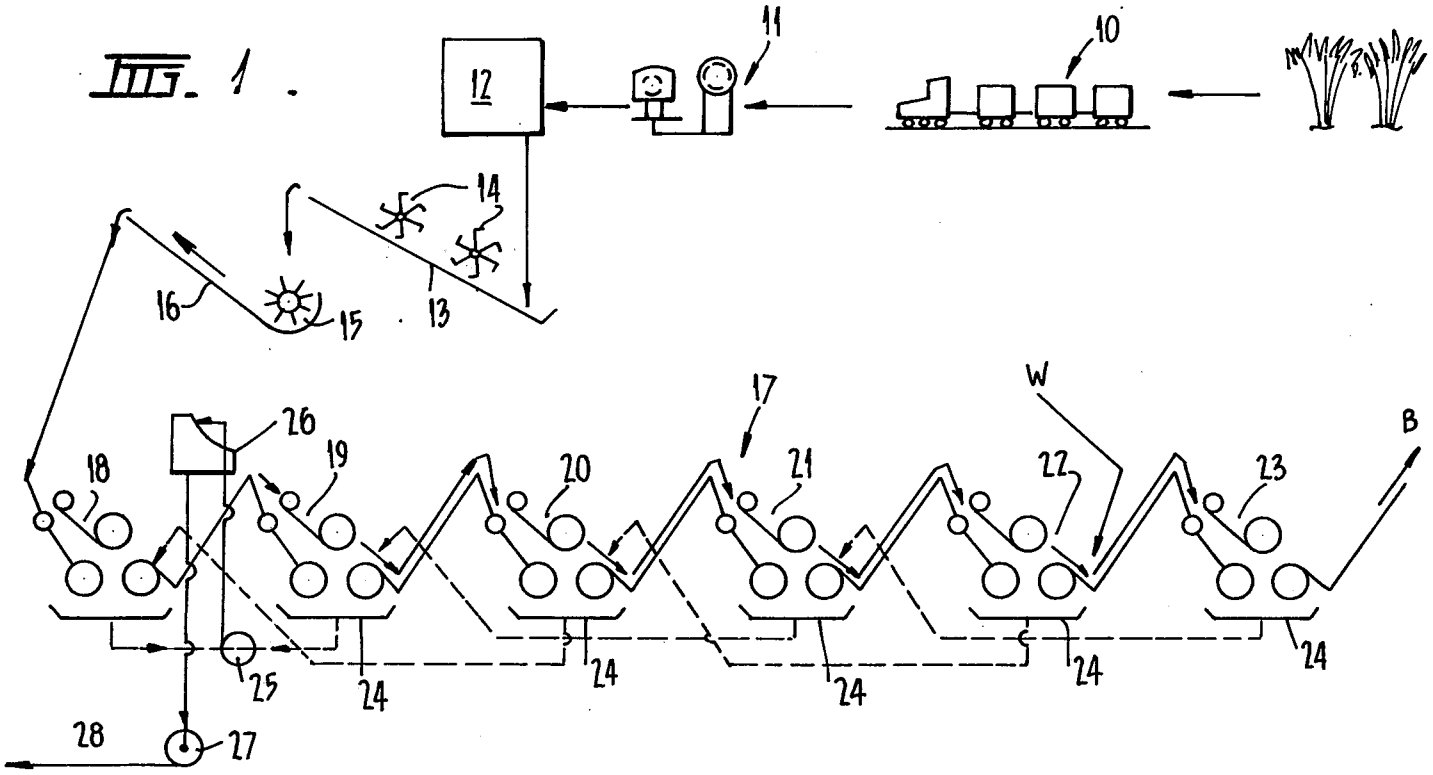

76
77
78
79
80
81
82
83
84
85
86
87
88
89
90
91
92
93
94
95
95a
96
97
98
99
100
101
102
103
104
105
106
107
M
S

TREATMENT OF RAW SUGAR JUICE

This invention relates to improvements in the production of raw sugar from sugar cane.

The invention particularly relates to an improved method, and a system for carrying out the method, for treating raw sugar juice involving clarification of the juice to produce clarified juice for subsequent treatment, and clarifier mud which is subsequently treated to enhance the recovery of sugar from the mud and also to facilitate disposal of mud solids.

In the production of raw sugar cane, raw sugar juice is obtained from the sugar cane by cutting the cane and crushing it together with some softening thereof to obtain raw sugar juice, and sugar cane residue known as bagasse.

The raw sugar juice is then purified, concentrated by evaporation and then crystallized to obtain raw cane sugar and molasses as the final products. The raw sugar cane is generally then processed by a sugar refining process to obtain white sugar.

The raw sugar juice obtained by crushing of the sugar cane is turbid and discoloured and contains large amounts of dirt or mud, which is usually present in the sugar as harvested, together with other solids such as fibrous, and pith or corky, materials. Clarification of the raw sugar juice is accomplished by liming, heating and settling to separate as much as possible of the insoluble suspended and colloidal solids from the juice prior to the evaporation process.

It is common practice to perform the separation step after the liming and heating step by using sedimentation chambers in a conventional commercial clarifier. The clarifier overflow comprises a clear juice or liquor which is removed from the top of the clarifier and is sent to the evaporators. The remaining liquid suspension of high solid contents is drawn from the bottom of the clarifier and is normally referred to as clarifier mud. In addition to dirt, fibrous and pith or corky materials, the clarifier mud may also contain other solids such as insoluble salts, natural gums and resins which has been precipitated and coagulated during the preceding liming and heating step.

Clarifier mud is usually removed from the clarifier in large quantities and has a relatively high sugar content thus making it economically desirable to further process the mud and recover as much of the sugar content as possible rather than disposing of the clarifier mud after being withdrawn from the clarifier.

The processing of the clarifier mud has in the past been carried out by filtration in a filter press or preferably a rotary vacuum filter.

It has been found that even under the most favourable circumstances the filtration of clarifier mud is a difficult and inefficient operation subject to many disadvantages such as difficulty in disposing of the filter cake, absorption of substantial part of the sugar juice in the filter cake, and the necessity to recycle to adequately filter which recycling subjects the sugar content to prolonged exposure to high temperatures and results in the tendency for the wax component of the filter cake to pass into the recycled filtrate and complicate the subsequent evaporation and crystallization operations following the clarifier.

It has been previously proposed that the clarifier mud be subjected to a process of centrifugal separation instead of filtration to overcome the above problems with filtration, and one such centrifugal separating process is described in U.S. Pat. No. 3,501,346. The process disclosed in this prior art specification involves treating clarifier mud, produced during clarification operation, under controlled temperature, pH and flocculent addition conditions in a continuous bowl centrifugal separator to separate and recover the sugar juice with a minimum of suspended solids content. The separated thickened mud cake is then subjected to one or more counter-current washing operations with water to recover the major part of the sugar content of the mud cake, the washings being combined with recovered clarified sugar juice from a first stage separation.

However, in utilization of centrifugal separation many fine grits or dirt, such as those solids inherited from the harvested sugar and other fibrous and pith or corky material, remain in the clarifier mud. When the clarifier mud is subsequently subjected to high centrifugal forces and vibrations in the centrifugal separator the mentioned fine grits or dirt impinge on the various components of the separator, and despite the use of tungsten carbide at various places in the separator, produce accelerated wear and erosion of the components, whilst furthermore gravitation of such grits or dirt between moving parts having close tolerances leads to the necessity for frequent maintenance and replacement of parts in the separator.

It is therefore an object of the present invention to provide a method, and a system incorporating the method, for treating raw sugar juice involving centrifugal separators for processing the clarifier mud where the above disadvantage is substantially overcome.

This object is basically achieved by subjecting the raw sugar juice to a degritting process prior to clarification thereof, whereby as much as possible of undesirable grit or dirt is removed prior to reaching the clarifier, such that, the clarifier mud drawn from the bottom of the clarifier for further treatment in the centrifugal separator or separators is substantially free of wear inducing and eroding dirt and grit.

The invention therefore envisages a method of treating raw sugar juice including the steps of clarifying the raw sugar juice and processing the clarifier mud produced in a centrifugal separator, wherein prior to clarifying the raw sugar juice the juice is subjected to a degritting process.

The invention also envisages a system for treating raw sugar juice comprising a clarifier having means for extracting clarified juice from the clarifier for subsequent evaporation and crystallization, and means for extracting clarifier mud from the clarifier and delivering the clarifier mud to at least one centrifugal separator, and including means prior to the feed for the clarifier for degritting the raw sugar juice prior to reaching the clarifier.

Preferably the degritting process is carried out in an apparatus utilizing cyclone separators through which the majority of the raw sugar juice passes prior to delivery to the clarifier.

Figure 2:
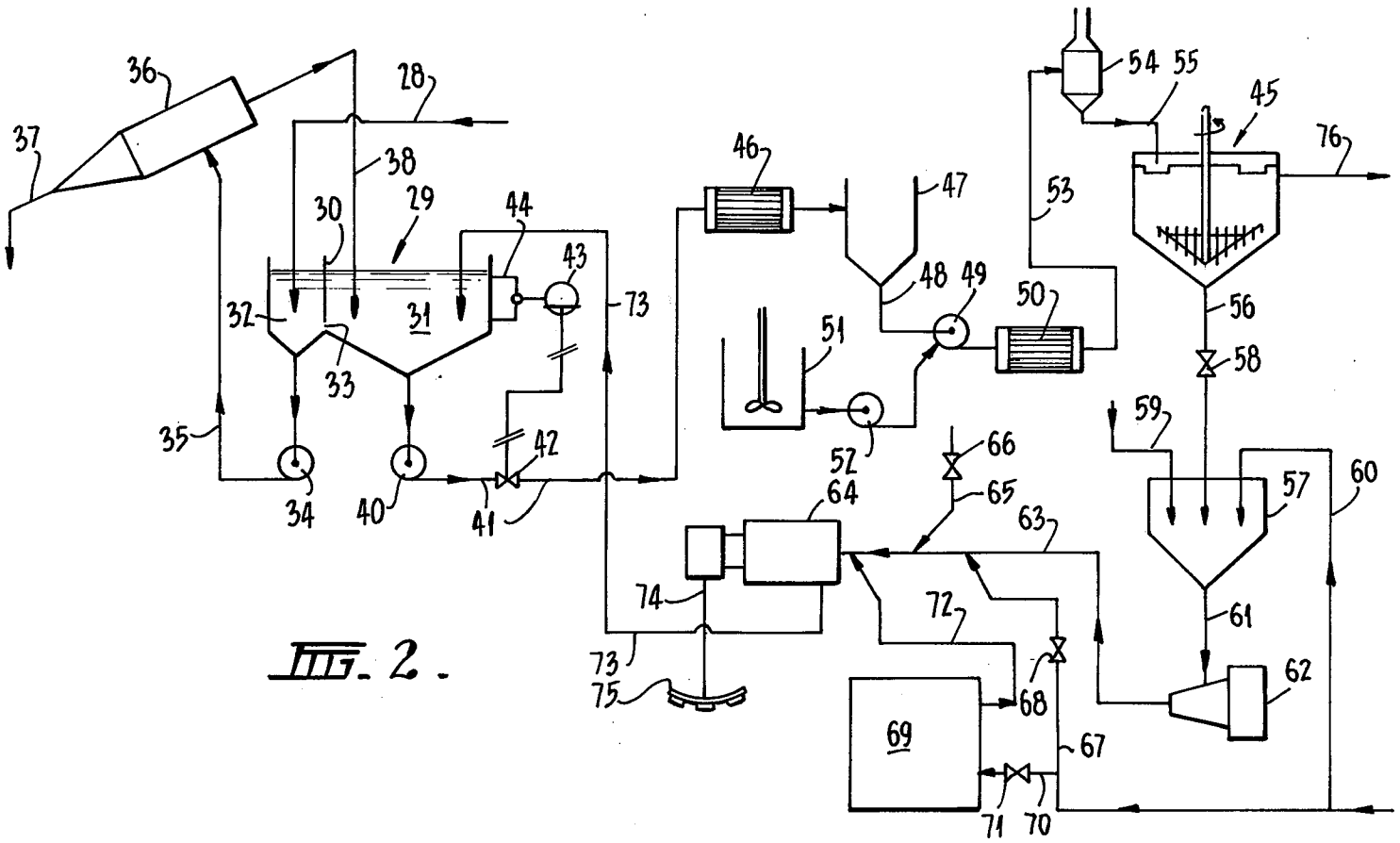
Figure 3:
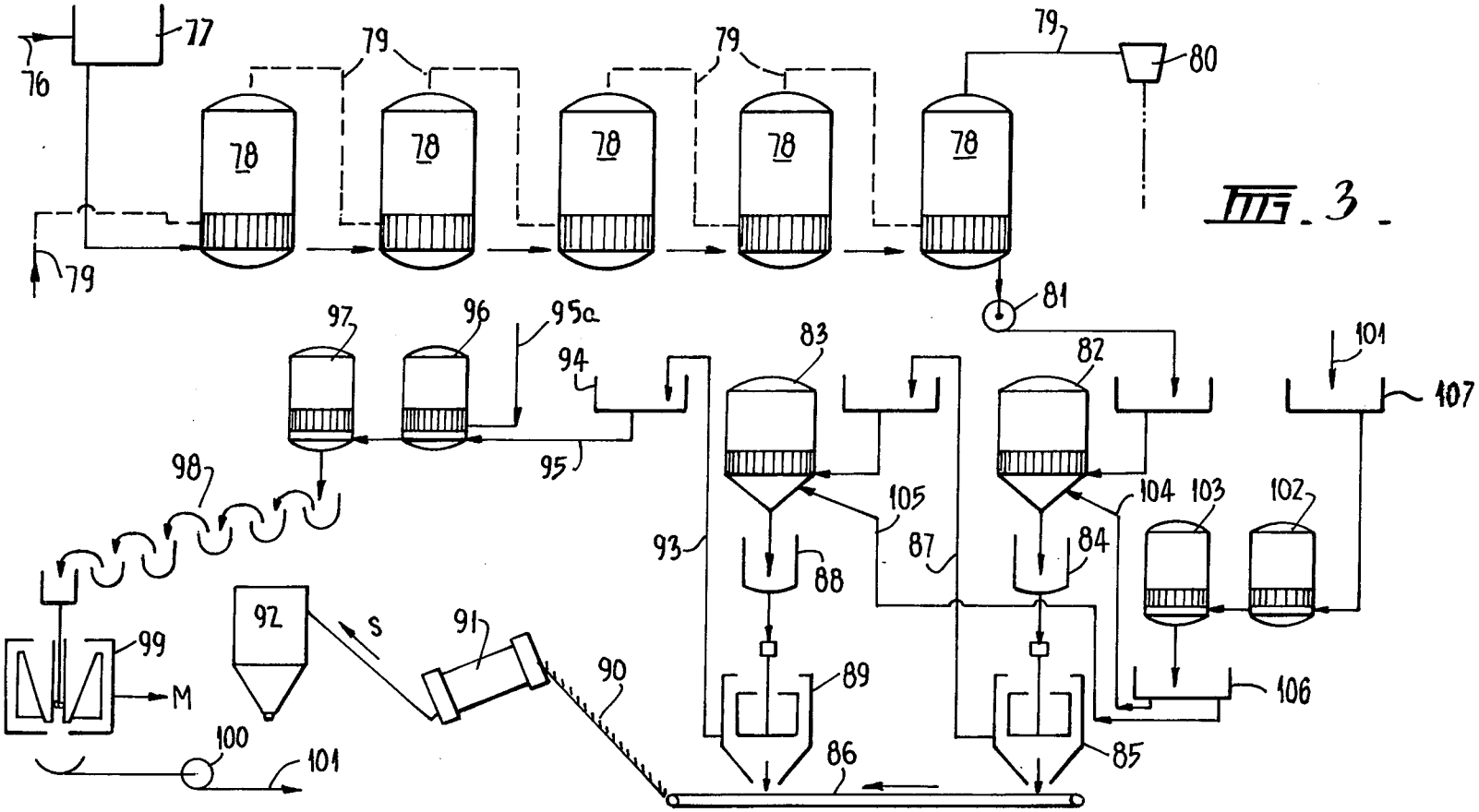

One preferred form of the present invention will now be described with reference to the accompanying drawings in which:

FIG. 1 is a detailed flow sheet illustrating the sequence of processes, and equipment therefore, from the point of harvesting the sugar cane to the point where raw sugar juice has been extracted for further processing according to the present invention, FIG. 2 is a detailed schematic flow sheet for that section of the process, and the equipment therefor, following the process of FIG. 1 for treatment of the raw sugar juice to the point of clarification and prior to passing to subsequent evaporation and crystallization processes and in particular that point of the process, and the equipment therefor, which embodies the present invention, and FIG. 3, is a detailed flow sheet illustrating the sequence of processes, and equipment therefor, performed on the clear juice or liquor obtained after clarification through to the final raw sugar and molasses products.

Referring to FIG. 1 of the drawings, there is shown the sequence of events, and equipment leading to the production of raw sugar juice from harvested sugar cane, for subsequent processing according to the present invention before being subjected to the clarification process.

As shown schematically in FIG. 1, sugar cane after being harvested is transported by whatever means are convenient, usually cane trains 10, to the processing plant where it is initially weighed at a weighing station 11 and transferred to a truck or bin facility 12. From the facility 12 the cane is delivered to a conveyor unit 13 up which it is conveyed whilst being subjected to a cutting action by rotating cutting knife arrangements 14 mounted above the conveyor unit 13 and in the path of the cane being conveyed thereon. The cane delivered from the conveyor unit 13 has been effectively cut to lengths of a manageable size for a shredding unit 15 at the discharge end of the conveyor unit 13. From the shredding unit 15 the shredded cane is conveyed on a further unit 16 to the input end of a milling train generally indicated as 17. In the embodiment illustrated the milling train 17 includes 6 milling stages 18, 19, 20, 21, 22, and 23 beneath each of which raw sugar juice accumulates in collecting trays 24 and from the last milling stage 23 bagasse B is removed which may be used as boiler feed. In the milling train 17 illustrated the raw sugar juice is collected from the collecting trays 24 from the first two milling stages 18 and 19, whilst the raw sugar juice from the trays 20, 21, 22 and 23 of the following milling stages may be recycled back to the milling stage preceding the immediate preceding stage. As is normal practice water W is added to the bagasse before entry to the last milling stage 23 in order to assist in extracting as much of the residual juice as possible. The raw sugar juice accumulating in the collecting trays 24 for the first two mill stages 18 and 19 is pumped via pump 25 through a system of filter screens generally indicated as 26 and from there is pumped via raw sugar juice feed pump 27 through a fluid line 28 to the next stage of the process to be described with reference to FIG. 2 of the drawings, being that section of the overall system which incorporates the invention the subject of the present application. The process, and equipment therefore, described above for producing the raw sugar juice is generally conventional and has been included to assist in giving an overall picture of a complete sugar refining system, whereby the section of the system to which the invention relates will be appreciated within the context of a total typical system.

With reference to FIG. 2 of the drawings, raw sugar juice enters this section of the process by virtue of fluid line 28 under the action of the feed pump 27 (FIG. 1), and at this point in the process is usually impure and in a typical example has a pH factor of, for example 5.5, and includes approximately 99.5% of juice and in the order of 0.5% of impurities made up of Soil (grits), Stalks and Salts, and may be delivered at rates of up to 250 tons of juice/hour. At this rate approximately 1000 gallons/minute ± 10% of raw sugar juice enters this stage of the system and is initially fed to the smaller tank section of a surge tank 29 divided by a partition 30 into a large and a small tank sections 31 and 32 respectively, with communication between the two tank sections being via a gap 33 between the lower end of the partition 30 and the bottom of the tank 29. In this example of the system the size of the surge tank 29 and the subdivision by the partition 30 is such as to allow a capacity of 1000 gallons in the small tank section 32 and 10,000 gallons in the large tank section 31.

The raw sugar juice is drawn from the bottom of the small tank section 32 and pumped by a juice pump 34 at a rate of up to 1100 gallons/minute through a feed fluid line 35 to three cyclone separators 36 in parallel (only one shown). In the cyclone separators 36 heavy solids such as dirt and grit are separated in a manner well known for cyclone separators involving revolving the juice at high speed such that the heavy solid constituents are flung outwardly to the inner surface of the cyclones for subsequent removal therefrom and discharged through discharge conduit 37 into a receiving hopper (not shown), for periodic disposal. The substantially solid free juice is extracted through fluid line 38 and delivered to the larger tank section 31 of the surge tank 29. Suitable cyclones 36 for the purpose of the present invention are marketed under the trademark DORRCLONE and should be generally capable in the present system for handling up to 1100 gallons/minute of juice between them.

Juice which is substantially free of heavy solid impurities is extracted from the bottom of the larger section 31 of the surge tank 29 through fluid line 39 and pumped via a further juice pump 40 through a fluid line 41. The fluid line 41 includes a throttle valve 42 which cooperates with a level control device 43 which acts in response to a level sensing device 44 adapted to sense juice levels in the surge tank 29 over a relatively large range of depths. With such an arrangement the effective delivery through the fluid line 41 to the following processes can be adjusted in accordance with any fluctuations in the depth, and therefore quantities of, juice in the surge tank 29, that is, any major depletion of the supply line in the surge tank produces a partial closing of the throttle valve 42 via the arrangement of level sensing device 44 and level control device 43 to allow less volume to be transferred through fluid line 41 until such time as the level in the surge tank 29 increases to maintain an adequate supply. Conversely if the surge tank is filled to close to maximum capacity the throttle valve 42 is controlled to be close to, if not fully, opened to allow maximum flow through the fluid line 41. On the average approximately 1000 gallons/minute is fed to the following processes through fluid line 41 and in fact should normally maintain an approximately constant level.

Prior to being fed to the clarifier or subsider generally indicated as 45 in FIG. 2, the relatively solids free sugar juice is passed through a series of conventional sugar juice treatments, for example the juice may be passed through a first steam heating unit 46 in which the juice temperature is raised to approximately 70° C before being delivered a treatment tank 47, with a capacity of approximately 30,000 gallons, and in which starches in the juice are removed. The treated juice is drawn from the starch treatment tank 47 through fluid line 48 and pumped by a further juice pump 49 to a second steam heating unit 50 designed to further raise the temperature of the juice to approximately 110° C. The further pump 49 raises the pressure of the juice to approximately 50 p.s.i. at a flow rate of approximately 1000 gallons/minute and at the pump a quantity of lime is added to the juice for the purpose of compensating for Acids in the juice and assisting in precipitating phosphates. Normally the lime with a water carrier is mixed in the mixing tank 51 and pumped by lime pump 52 to unite with the sugar juice at the juice pump 49.

The relatively superheated juice under pressure issuing from the second steam heating unit 50 is transferred through fluid line 53 to a flash unit 54 in which upon the release of pressure and steam air bubbles in the juice are released, before the juice is fed through fluid line 55 to the clarifier or subsider 45 at the rate of about 1000 gallons/minute.

In the clarifier 45, although most of the heavy solids such as dirt and grit have been previously removed in the degritting section of the system, lighter solids still remaining settle in suspension to the bottom of the clarifier 45 whilst the clear juice or liquor is removed from the top of the clarifier at approximately the level of the juice therein for feeding to subsequent processes utilising evaporators and then onto the crystallization process as is common practice in the art and is described in some detail later with reference to FIG. 3.

The capacity of the clarifier may for example be within the range 30,000 to 120,000 gallons. The suspension of solids or clarifier mud in the bottom of the clarifier 45 gravitates through line 56 into a mixing tank 57. The line 56 includes a valve 58 to shut-off feed to the mixing tank 57 when desired and approximately 50 to 100 gallons/minute will be allowed to gravitate into the mixing tank with a capacity of approximately 200 gallons.

In the mixing tank 57 steam is added through line 59 together with fiber bagacillo and also perhaps diluting water through line 60 from a water supply, and the ingredients, including the clarifier mud, are mixed in the mixing tank 57 before being fed from the bottom thereof through line 61 to a positive displacement pump 62 which feeds the clarifier mud through line 63 to the feed line of one or more continuous bowl centrifugal separators 64, in which sugar juice in the clarifier mud is separated and recovered with a minimum of solids content.

The diluted clarifier mud being delivered to the centrifugal separators 64 at a rate of approximately 100 gallon/minute may have further dilution water added thereto together with hot wash water and flocculent. The further dilution water, which may be supplied at the rate of 80 gallons/minute, apart from dilution may also assist in washing the separators out. The hot wash water may also be added at the rate of 80 gallons/minute and it together with the flocculent are either added to the clarifier mud feed prior to entering the separators 64 or are added within the separators 64. Hot wash water in the embodiment illustrated is added to the feed line 63 via wash water feed line 65 having a shut-off valve 66, whilst dilution water is fed from the water supply through line 67 including a valve 63. Flocculent is prepared in a flocculent station 69 and is fed at the rate of approximately 20 parts per million on the mud, with dilution water via line 70 through valve 71 in communication with water feed line 67 from the water supply, and the flocculent is added in this embodiment to the feed line 63 for the clarifier mud via the fluid line 72.

In the continuous bowl centrifugal separators 64 sugar juice having a minimum of suspended solids content is separated and recovered and then delivered through line 73 to the larger section 31 of the surge chamber 29 for recirculation through the system. Mud cake from the separators 64 is fed therefrom and delivered through a supply means 74 to a belt conveyor 75 for subsequent discharge.

As mentioned previously the degritting process is the crucial part of the inventive method and system, in that despite the provision of tungsten carbide on parts likely to encounter the most severe wear in the centrifugal separators 64, the forces involved are of sufficient magnitude to greatly increase the wear and erosive power of the grits if the grits are not removed.

In the practical example of the system described three cyclone separators 36 are utilised and as stated one particular type of such cyclone separator that may be used is that marketed under the trademark DORR-CLONE and in particular a 12 inch SW DORR-CLONE separator having 4 inch vortex finders and ½ inch tubular apex valve operating up to 20 p.s.i. pressure drop is suitable for the purpose required. The cyclone separators may be mounted at an angle of 10° -15° (e.g. half cone angle of cyclone) to the horizontal with the apex valve directly over a grit screw Conveyor/-Washer.

The control of the throttle valve 42 in fluid line 41 by the level sensing device and control device 44, 43 maintains a relatively constant level in the surge tank 29 and therefor ensures a constant feed to the juice pump 34 and thus the cyclone separators 36. A substantially constant flow is particularly desirable for achieving substantially constant pressure drop across the cyclone separators 36.

In the event of failure of the juice pump 34, the sugar juice will merely be circulated by the juice pump 40 and through to the following processes thus completely by-passing the cyclone separators until the juice pump can be repaired or replaced.

The mixing tank 57 may utilise a float valve to control the level therein. The steam delivered through line 59 to the mixing tank 57 may be adapted to raise the temperature of the clarifier mud in the mixing tank to something in excess of 200° F. Some hot water may also be added to dilute the mud and lower the brix of the juice in the mud which assists in the sugar recovery. A flowmeter may be introduced into the line 56 from the clarifier 45. A temperature recorder and/or controller may also be provided for the mud tank 57.

The continuous bowl centrifugal separator or separators may be of the type marketed under the trademark MERCOBOWL having three sets of sheaves for operation at 3000, 3500 or 4000 RPM with four regulating rings allowing four different pool depths within the separator and driven by a 40HP 2 pole 415 volts 3 phase motor.

Also a centrifugal separator of the type disclosed in U.S. Pat. No. 3,501,346 may be successfully adapted for use in the system of the preferred embodiment, or alternatively a centrifugal separator having separate feeds for the wash water and/or flocculent to allow delivery into the separator separately from the feed of clarifier mud, may be utilised, for example, that disclosed in Australian Patent Application No. PB 7339.

Referring to FIG. 3 of the drawings, which is included for the sake of completeness of description of the complete sugar treatment process, but not for the purpose of describing that section of the process and equipment which essentially embodies the invention, the clear juice or liquor which flows out from the top of the clarifier 45 is gravity fed through fluid line 76 to conventional evaporation and crystallizaion units as is common practice in the art.

With the process and equipment illustrated with respect to FIG. 3, the clear juice gravitates through fluid line 76 into a clarified juice tank 77 and from the tank 77 through a series of multiple effete evaporator vessels 78, the first steam heated by lower pressure exhaust steam line 79 with the final vapour being condensed in the condenser 80. The final syrup produced has a solid content of approximately 60% and is withdrawn from the final evaporator vessel and pumped by syrup pump 81 to one, or the other of a pair of vacuum units or pans 82 and 83, together with a quantity of fine sugar crystals known and used as footing or seed and known as magma. The syrup is further evaporated to produce a magma of large crystals and syrup A massecuite which is discharged into an associated receiver 84 for subsequent feeding into a first centrifugal separator or fugal 85 to separate the sugar crystals from the cane molasses called A molasses. The sugar crystals gravitate from the fugal 85 onto a conveyor 86, with the A molasses being fed through fluid line 87 to the second of the vacuum pans 83 together with some footing or feed crystals where it undergoes further evaporation to obtain a further strike of large sugar crystals. The magma of further crystals and cane molasses B massecuite is discharged into the receiver 88 associated with the vacuum pan 83 and the magma is fed into a further fugal 89 to separate the further sugar crystals from the molasses now called B molasses, with the sugar crystals gravitating onto the conveyor 86.

The sugar crystals on the conveyor 86 are conveyed up to an elevator 90 which feeds the crystals into a revolving drum dryer 91 from which the dried sugar (S) issues and is conveyed into a sugar storage bin 92. In this example the B molasses residue from the second fugal 89 is fed through fluid line 93 to a receiver 94 for subsequent feeding through fluid line 95 to a pair of vacuum pans 96 and 97 in series where, mixed with a slurry of very fine white sugar crystals fed through line 95*a*, it is further evaporated, and subsequently cooled and crystallised through crystallisers 98. Thereafter further separation is carried out in a further fugal 99 from which final or C molasses (M) is extracted with the residue in the form of a quantity of fine sugar crystals magma is removed. These crystals are mixed with syrup to form a magma which is transferred via pump 100 and line 101 to vessel 107 to be then boiled in two additional vacuum pans 102 and 103 to grow the crystals to a size sufficient to be satisfactory as aforementioned footing or seed, which material is stored in vessel 106 ready for use as base or foundation for production of large sugar crystals of high qualtiy (A and B) raw sugar in vacuum pans 82 and 83.

As stated previously the production of raw sugar juice described and illustrated with reference to FIG. 1, and the final treatment of the clear sugar juice issuing from the clarifier to produce sugar crystals and molasses as described and illustrated with reference to FIG. 3, are merely examples of how these processes may be performed in a typical plant, with the preferred form of basic concept of the present invention being generally only disclosed with reference to the description relating particularly to FIG. 2 of the drawings, which in itself includes many features which are also merely preferments and are not essential to the invention.

I claim:

1. A method of processing sugar cane including the steps of subjecting the sugar cane to cutting, shredding and milling operations to produce raw sugar juice and bagasse, subjecting the raw sugar juice and bagasse to a first separation step to remove large fractions of bagasse from the raw sugar juice, subjecting the separated raw sugar juice to a cyclone separation step comprising a degritting process to produce a sugar juice substantially free of fine grits, clarifying the raw degritted sugar juice to produce sugar liquor and clarifier mud, the clarifier mud from said clarifying process being subsequently processed in one, or more, solid bowl centrifuges to produce relatively clear sugar juice for recycling through the clarification process, with the sugar liquor from the clarifying process being subsequently subjected to evaporation and crystallization processes to produce raw sugar.

2. A system for processing raw sugar juice comprising a separator for receiving the raw sugar juice and bagasse from a milling process and including means for removing large and bulky fractions of material including bagasse from the raw sugar juice, a clarifier having means for extracting clarified juice from the clarifier for subsequent evaporation and crystallization, cyclone means arranged prior to the feed for the clarifier comprising a plurality of cyclone separators for degritting the separated raw sugar juice received from the separator by removing heavy solid constituents prior to reaching the clarifier, and means for extracting the degritted clarifier mud from the clarifier and delivering the degritted mud to at least one solid bowl centrifugal separator.

3. A system as claimed in claim 2, wherein the raw sugar juice from the, or each, centrifugal separator is fed back to the feed for said clarifier.

4. A system as claimed in claim 2, wherein raw sugar juice produced in a preceding crushing mill arrangement is delivered to a first section of a surge chamber from which section it is fed to the, or each, said cyclone separator from which the relatively solid free juice is delivered to a second section of said surge chamber from which it is withdrawn and fed to said clarifier, said surge chamber being partitioned to provide said first and second sections having an opening therebetween for allowing fluid communication between said sections to maintain a common level of juice in said sections.

5. A system as claimed in claim 4, wherein said feed line between said surge chamber and said clarifier includes a throttle valve therein cooperating with level sensing and control means for said surge chamber, whereby the rate of delivery through said feed line is varied by said throttle valve to maintain the level of juice in said surge chamber within predetermined limits.

6. A system for processing sugar cane including means to cut and shred lengths of said cane, a milling train to crush said cane and extract raw sugar juice and bagasse therefrom, a separator for removing large fractions of material including bagasse from the extracted raw sugar juice, degritting means including a plurality of cyclone separators operable to remove grit and like solid materials from the separated raw sugar juice, means for feeding said degritted raw sugar juice from said degritting means to a clarifier, said clarifier having means for extracting clarified juice from the clarifier for subsequent forwarding to evaporation and crystallization means, means for withdrawing the degritted clarifier mud from the clarifier and delivering the degritted clarifier mud to at least one solid bowl centrifugal separator, and means to feed the juice produced in the, or each, solid bowl centrifugal separator back to the feed for said clarifier.

* * * * *